US006796228B2

(12) United States Patent
Goodwin et al.

(10) Patent No.: US 6,796,228 B2
(45) Date of Patent: Sep. 28, 2004

(54) DAMPENER METERING DEVICE

(75) Inventors: Lyle Goodwin, Arlington Heights, IL (US); Arthur Pudark, Downers Grove, IL (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 10/331,014

(22) Filed: Dec. 27, 2002

(65) Prior Publication Data

US 2004/0123752 A1 Jul. 1, 2004

(51) Int. Cl.[7] ..... B41F 7/40
(52) U.S. Cl. ..... 101/148
(58) Field of Search ..... 101/147, 148, 101/351.1, 351.3, 351.4, 352.01, 352.04, 352.05, 479, 480

(56) References Cited

U.S. PATENT DOCUMENTS

| | | | | | |
|---|---|---|---|---|---|
| 2,795,188 | A | | 6/1957 | Williams | 101/348 |
| 3,168,037 | A | | 2/1965 | Dahlgren | 101/148 |
| 3,552,311 | A | * | 1/1971 | Petri | 101/148 |
| 3,691,956 | A | * | 9/1972 | James et al. | 101/247 |
| 3,769,909 | A | | 11/1973 | Fugman et al. | 101/148 |
| 3,911,815 | A | * | 10/1975 | Banfer | 101/148 |
| 4,242,958 | A | | 1/1981 | Jeschke | 101/365 |
| 4,244,292 | A | | 1/1981 | Williams et al. | 101/350.3 |
| 4,290,360 | A | * | 9/1981 | Fischer | 101/148 |
| 4,385,559 | A | | 5/1983 | Jarach | 101/148 |
| 4,395,947 | A | * | 8/1983 | Despot | 101/352.02 |
| 4,429,631 | A | * | 2/1984 | Commers | 101/350.3 |
| 4,440,081 | A | * | 4/1984 | Beisel | 101/148 |
| 4,455,938 | A | | 6/1984 | Loudon | 101/148 |
| 4,656,940 | A | | 4/1987 | Turturro et al. | 101/351.4 |
| 4,838,163 | A | | 6/1989 | Jeschke et al. | 101/350.3 |
| 4,981,077 | A | | 1/1991 | Alvarez | 101/148 |
| 5,158,017 | A | | 10/1992 | MacConnell et al. | 101/148 |
| 5,355,796 | A | * | 10/1994 | Kobler et al. | 101/148 |
| 5,375,522 | A | * | 12/1994 | Junghans | 101/424 |
| 5,540,145 | A | * | 7/1996 | Keller | 101/148 |
| 5,551,338 | A | | 9/1996 | Wall et al. | 101/148 |
| 5,584,243 | A | * | 12/1996 | Kern | 101/479 |
| 5,676,057 | A | * | 10/1997 | Hummel et al. | 101/349.1 |
| 5,680,816 | A | | 10/1997 | White et al. | 101/148 |
| 6,095,042 | A | | 8/2000 | Jakobsen et al. | 101/148 |

* cited by examiner

*Primary Examiner*—Stephen R. Funk
(74) *Attorney, Agent, or Firm*—Pillsbury Winthrop LLP

(57) ABSTRACT

The subject invention discloses a dampener having a device for precisely metering dampening solution on a printing press. The dampener includes a form roller in contact with a plate cylinder on the printing press and a metering roller in contact with the form roller. The metering roller is supported in the dampener with eccentric collars. Adjustment devices are used for adjusting the eccentric collars to move the metering roller toward or away from the form roller. The adjustment devices can be adjusted without tools while printing press is running and the safety covers of the press are closed.

20 Claims, 11 Drawing Sheets

DAMPENER METERING DEVICE

BACKGROUND OF THE INVENTION

1. Field of the Invention

The present invention relates generally to a dampener having a device for precisely metering dampening solution to a plate cylinder in an offset lithograph printing press and, more particularly, to a dampener having a device configured to enable a press operator to finely adjust a roller toward and away from an adjacent roller for precise control of a film of dampening solution that is to be deposited on an offset lithographic printing plate.

2. Background of the Related Art

On a printing press utilizing the offset lithographic method of printing there is typically required a dampener for applying dampening solution to a printing plate to ensure that the non-image area of the plate and, consequently, the non-image area of the printed sheet, is kept clear of ink.

Generally, there are two types of dampeners used on offset lithographic printing presses: ductor-type dampeners and continuous-type dampeners.

Ductor-type dampeners include at least a form roller pressed against and rotating at the same speed as a plate cylinder (press speed) of a printing press, a pan roller rotating at less than press speed for picking up dampening solution from a pan, and a ductor roller that ducts back and forth between the form roller and pan roller. Although still sometimes sold by press manufactures, ductor-type dampeners are less efficient because they are unable to deliver an even film of dampening solution to the printing plate, thereby leading to imperfect ink-water balance and all of the printing conditions associated therewith.

There are basically two types of continuous-type dampeners: pan-type continuous dampeners and seal-type continuous dampeners. Pan-type continuous dampeners come in a wide variety of configurations but can be generally described to include at least a form roller pressed against a plate cylinder and rotating at press speed, a metering roller pressed against the form roller and rotating at press speed, and a pan roller pressed against the metering roller and positioned in a pan for picking up dampening solution Dampening solution is fed to the pan during printing operations. In some configurations the pan roller is rotated at less than press speed through the use of reduction gearing or an adjustable drive motor. Exemplary pan-type continuous dampeners are disclosed in U.S. Pat. No. 3,168,037 to Dahlgren and U.S. Pat. No. 5,158,017 to MacConnell, et al., both of which are incorporated by reference herein.

Seal-type continuous dampeners can be generally described to include at least a form roller pressed against a plate cylinder and rotating at press speed, and a metering roller pressed against the form roller and rotating at press speed. Seals are provided at the ends of the form roller and metering roller to form a reservoir for dampening solution above the nip between the rollers. Dampening solution is fed to the reservoir during printing operations. Exemplary seal-type continuous dampeners are disclosed in U.S. Pat. No. 3,769,909 to Fugman, et al., and U.S. Pat. No. 4,455,398 to Loudon, both of which are incorporated by reference herein.

In contrast to ductor-type dampeners, continuous-type dampeners are preferred because of their superior ability to provide a relatively even film of dampening solution to the plate, and thereby provide much improved ink-water balance.

Continuous-type dampeners, in particular pan-type continuous dampeners, include a number of adjustments to allow an operator to align the rollers so the dampener can provide an even film of dampening solution to the plate cylinder. A particularly critical adjustment is between the metering roller and an adjacent roller since this is where the film of dampening solution emanates. In a pan-type continuous dampener the film of dampening solution can be said to emanate from between the pan roller and the metering roller, and in a seal-type continuous dampener the film of dampening solution can be said to emanate from between the metering roller and form roller. The adjustments in these dampeners are, however, often rather crude and result in diminished print quality. In addition, the adjustments are not always accessible (e.g., they are under a safety guard) to a press operator during print operations. Further, the adjustments often require tools, which make it dangerous to make an adjustment when a press is rotating. Furthermore, because fine-tuning of a print operation takes place while a printing press is printing sample sheets, the efficiency of press operators and the quality of the printing job suffers if the printing press must be stopped each time an adjustment must be made to the dampener.

It will be well appreciated by those of ordinary skill in the art that there are numerous variables that make it necessary for operators to adjust the amount of dampening solution being delivered by a dampener in a printing press. These variables include: changes in ambient temperature between and during print jobs; changes in temperatures on the press during printing (e.g., higher press speeds causes certain press components to heat up); tack and viscosity of the ink; brand and concentration of the fountain solution; type of paper printed (e.g., NCR paper is very absorbent of solution while coated paper is significantly less absorbent of solution); the printing head of the press on which the dampener is mounted; run length of a printing job; age and condition of the rollers on the press; age and condition of the printing press; the operator's experience in adjusting ink flow; the operator's experience in setting roller pressures; and type of printing plate used (e.g., aluminum, polyester). The difficulties in adjusting and, in particular, fine-tuning a dampener severely hinder an operator's ability to overcome these variables.

There is clearly a need in the art for a dampener that includes an adjustment device that will eliminate the problems associated with present-day devices for making an adjustment between a metering roller and an adjacent roller (e.g., form roller, pan roller, intermediate roller.)

SUMMARY OF THE INVENTION

The subject invention discloses a dampener having a device for precisely metering dampening solution in the dampener. The dampener includes a first sideframe and a second sideframe for supporting rollers adjacent a plate cylinder in a printing press. A form roller is rotatably supported by the first and second sideframes in parallel relationship with and contactable with the plate cylinder during printing operations. A metering roller is rotatably supported by eccentric collars, which are rotatably supported by the first and second sideframes. The metering roller is positioned adjacent the form roller so a nip may be formed there between. Seals are pressed against end portions of the form roller and metering roller to form a dampening solution reservoir there between. Dampening solution is supplied to the reservoir during printing operations.

Adjustment devices for adjusting the eccentric collars are included. Each adjustment device includes an arm having a first end and second end. The first end is attached to the eccentric collar so the arm may be used to rotate the eccentric collar to move the metering roller toward and away from the form roller. The second end of the arm includes a threaded pivot. An attachment block is rotatably mounted to the side frame. An adjustment shaft has its first end threadingly engaged with the threaded pivot and its other end rotatingly mounted to the attachment block. By rotating the adjustment shaft the metering roller may be moved toward and away from the form roller. The adjustment device provides for precise metering of dampening solution in the dampener.

Further embodiments and features of the dampener having an adjustment device for precisely metering dampening solution will become readily apparent from the following detailed description taken in conjunction with the drawings.

BRIEF DESCRIPTION OF THE DRAWINGS

So that those of ordinary skill in the art to which the subject invention appertains will more readily understand how to make and use the invention described and claimed, embodiments of the invention will be described in detail with reference to the drawings wherein:

DETAILED DESCRIPTION OF PREFERRED EMBODIMENTS

Figure 1:
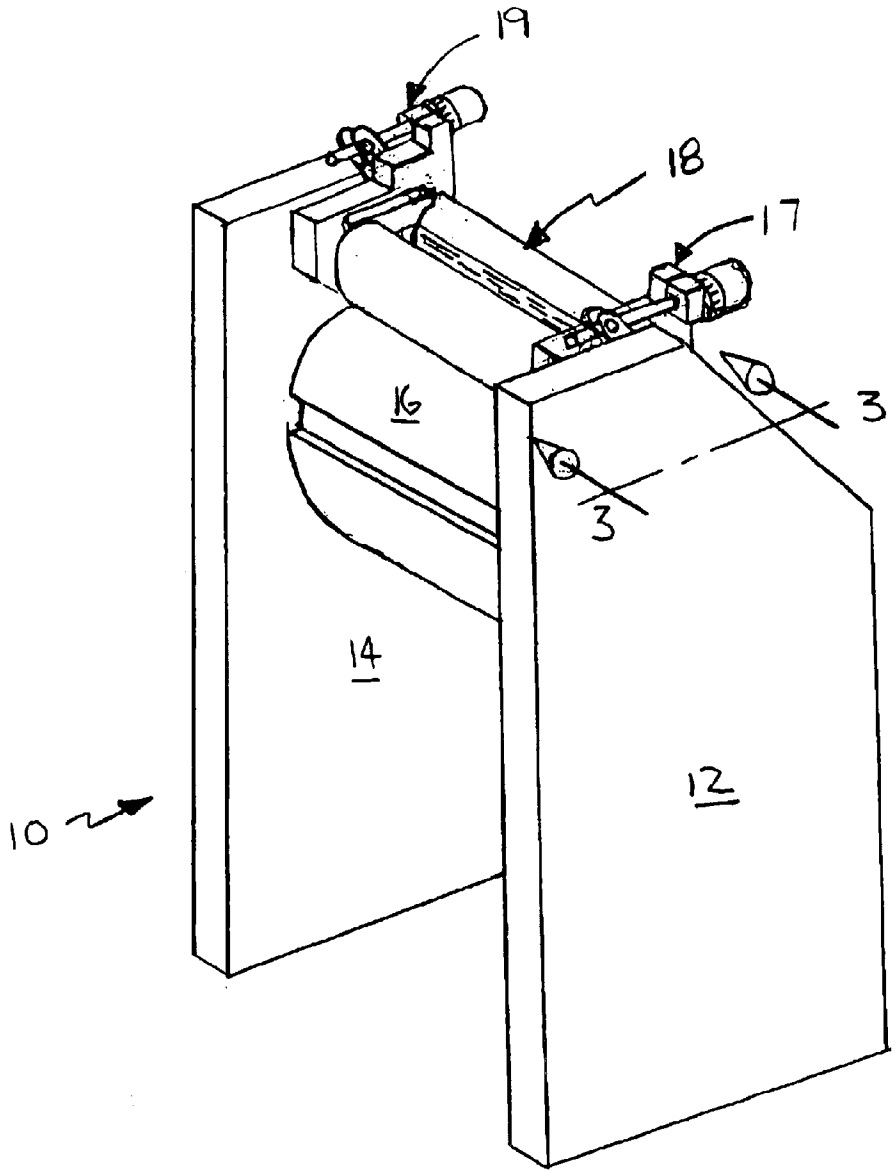
FIG. 1 is a perspective view of a printing press including an embodiment of the invention.

Referring now to the drawings, wherein like reference numerals identify similar structural elements of the subject invention, there is illustrated in FIG. 1 a single color-head printing press 10 including a seal-type continuous dampener 18 having an adjustment device for precisely metering dampening solution to a plate cylinder.

Printing press 10 is of the type used for offset lithographic printing and is shown greatly simplified to ease in illustrating the present invention. Those of ordinary skill in the art will appreciate that numerous additional components are required for an accurate depiction of an offset lithographic printing press (e.g., blanket cylinder, impression cylinder, inking rollers, roller hangers, cylinder drive motor and gearing, paper handling mechanism, safety guards, etc.)

Printing press 10 includes a near-side frame 12 and a far-side frame 14, between which is supported a plate cylinder 16. Printing plates, that is, aluminum or polyester sheets that are etched or otherwise processed to carry an image that is to be printed, are attached to the outer diameter of the plate cylinder 16. A seal-type continuous dampener 18 is mounted between the near-side frame 12 and far-side frame 14 adjacent plate cylinder 16. Dampener 18 includes an embodiment of an adjustment device for precisely metering dampening solution. The "device" includes a near-side component 17 and far-side component 19. In the description that follows the near-side component 17 is discussed in detail. The far-side component 19 is not separately discussed because it is symmetrical to the near-side component 17.

Figure 2:
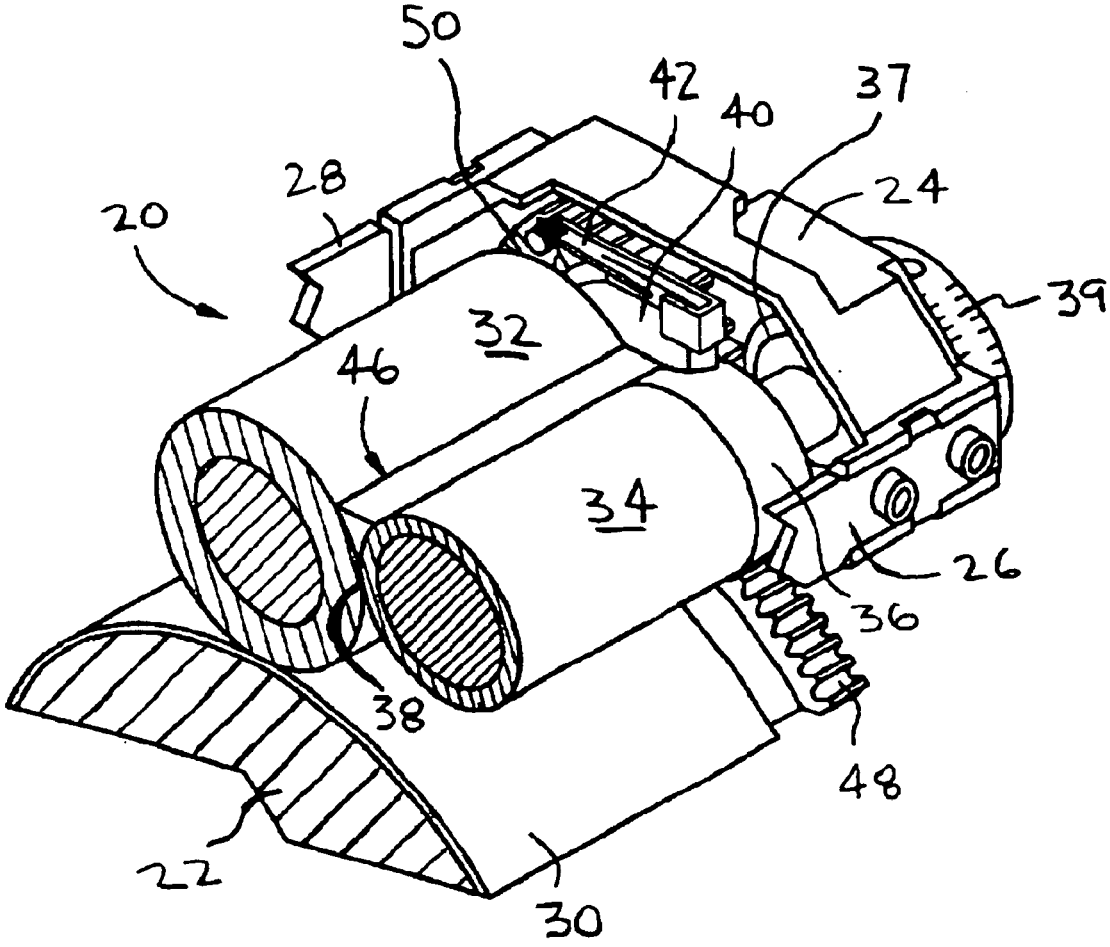
FIG. 2 (PRIOR ART)
FIG. 2 is a prior art seal-type continuous dampener.

To more fully appreciate the present invention and how embodiments thereof can improve a seal-type continuous dampener, a detailed description of a prior art seal-type dampener follows. Referring to FIG. 2, one side of a prior art seal-type continuous dampener is shown at 20 adjacent a plate cylinder 22. Except for a form roller gear, the opposite side of the dampener is symmetrical to the side shown and is therefore not separately described. The dampener includes side frames 24 tied together with front and rear cross members 26, 28. Rotatably supported between the side frames 24 and in contacting relation with a plate 30 mounted on the plate cylinder 22 is a form roller 32. In contacting relation with the form roller 32 is a metering roller 34. The form roller 32 has a steel core and resilient jacket. The metering roller 34 is somewhat longer than the form roller 32 and includes a DELRIN sleeve over a steel core and ceramic-coated steel end collars 36.

Between the form roller 32 and the metering roller 34 is formed a nip 38. Seal members 40 supported by seal carriers 42 are urged into contacting relationship with the radial ends of the form roller 32 and the circumferential surfaces of the end collars 36. Between the seal members 40 in a region above the nip 38 is formed a reservoir 46, wherein dampening solution is stored prior to being distributed through the nip 38. The metering roller 34 is adjusted toward and away from the form roller 32 to decrease and increase, respectively, solution passing from the reservoir 46 using eccentric collars 37. Graduated dials 39, which require tools to adjust, are used to rotate the eccentric collars 37.

To preserve the radial end surfaces of the form roller 32 and ensure a watertight seal between the seal members 40 and each roller, the seal members 40 are made of a sacrificial material such as TEFLON. A dampening solution feed mechanism (not shown) supplies and maintains the dampening solution at a predetermined depth in the reservoir 46.

Form roller 32 and metering roller 34 have hydrophilic/water receptive surfaces. The metering roller 34 is substantially less resilient than the form roller 32, thus the metering roller 34 tends to indent somewhat into the resilient jacket of the form roller 32 at the nip 38. A plate cylinder gear 48 drives a form roller gear 50 causing the plate 30 surface and form roller 32 surface to travel at a one-to-one surface speed ratio. The form roller 32 drives the metering roller 34 by friction at nip 38.

Referring to FIGS. 3–7, several views of the near-side sideframe of dampener 18 are shown. As noted above, dampener 18 is a seal-type continuous dampener. Therefore, it is substantially similar to the seal-type continuous dampener 20 shown in FIG. 2 and described herein above. However, several components are not shown (e.g., seal carriers 42, seal members 40, front cross member 26, rear cross member 28, form roller gear 50) to facilitate a detailed description of an embodiment of the invention.

A form roller 52 is rotatably supported (e.g., with ball bearings) by near-side sideframe 54 and a far-side sideframe (see FIG. 1) in parallel relationship with and contactable with the plate cylinder 16 during printing operations. A metering roller 56 is rotatably supported (e.g., with ball bearings) by eccentric collars 58, which are rotatably supported by the near-side sideframe 54 and far-side sideframe (see FIG. 1). The metering roller 56 is positioned adjacent the form roller 52 so a nip 60 may be formed there between. When the eccentric collars 58 are rotated within the sideframes, the eccentric collars 58 rotate about axis "A" and the bearing cups machined into the eccentric collars, having axis "B", move about axis "A" toward the form roller 52 (arrow "C") for reducing the amount of dampening solution allowed to pass through the nip 60, or away from the form roller 52 (arrow "D") for increasing the amount of dampening solution allowed to pass through the nip 60.

Each sideframe includes an adjustment device 17, 19 for adjusting the eccentric collars 58. Each adjustment device includes an arm 62 having a first end and a second end. The first end of the arm 62 includes a split-ring configuration which is assembled to a shoulder of the eccentric collar 58 and clamped in place with a fastener 64. The second end of the arm 62 includes a cross-hole 63 in which a threaded pivot 65 is positioned. The threaded pivot 65 rotates freely in the cross-hole 63.

Figure 3:
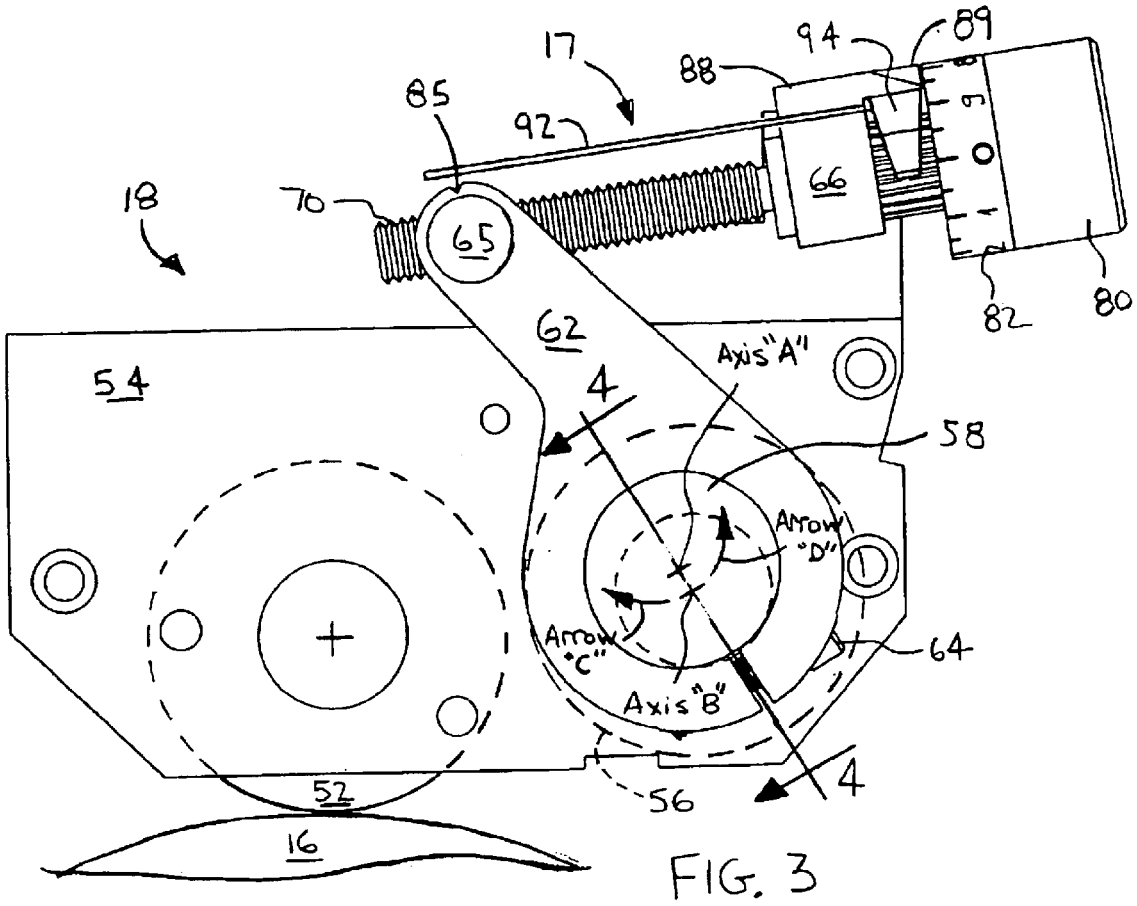
FIG. 3 is a side view of a seal-type continuous dampener, the view taken along line 3—3 of FIG. 1, that incorporates an embodiment of the present invention (the sideframes and other components of the printing press are not shown so to simplify the description of the invention)
Figure 4:
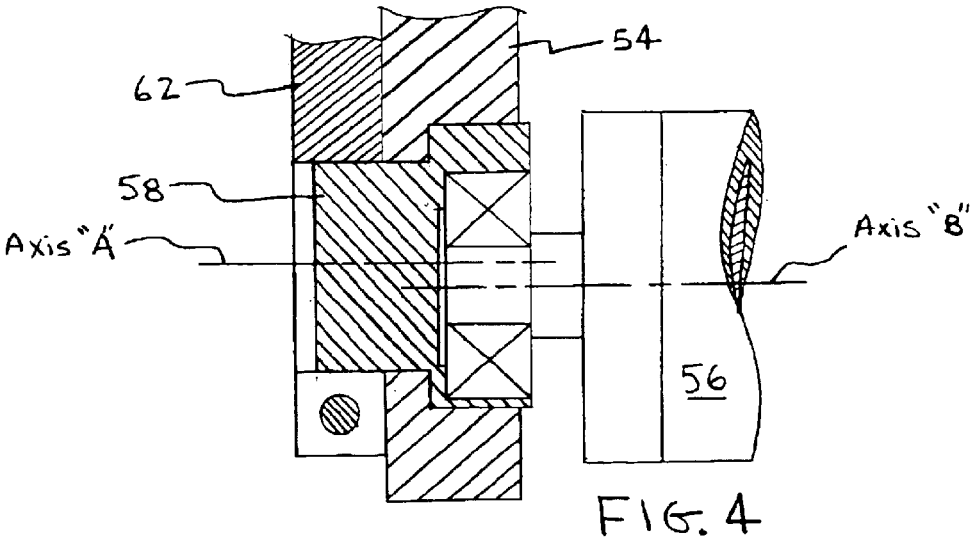
FIG. 4 is a cross-sectional view of a portion of the dampener shown in FIG. 3, the view taken along line 4—4 of FIG. 3, showing an eccentric collar and related components.

The near- and far-side arms 62 should be secured to the eccentric collars 58 in such a position so that when the arms 62 are tightened to the eccentric collars 58 and the arms 62 are in a forward position as shown in FIG. 3, a gap is formed between the metering roller 56 and form roller 52. This position facilitates cleaning of the dampener 18 and saves wear on the rollers when, as in a multi-head printing press, the particular printing head is not in use during printing operations.

An attachment block 66 having a cross-hole 67 is mounted to the sideframe 54 so it may freely rotate. The attachment block 66 is clipped in place with a retention ring 68. The method of mounting may be described as "rotatably mounting" the attachment block 66 to the sideframe 54.

An adjustment shaft 70 includes a threaded first end 72, a threaded second end 74, a collar 76, and a smooth shoulder 78. The threaded first end 72 is threaded into the threaded pivot 65 mounted on the second end of the arm 62. The threaded second end 74 extends through the cross-hole 67 in attachment block 66 so that the collar 76 contacts the attachment block 66 and the smooth shoulder 78 rides in the cross-hole 67 of attachment block 66.

An adjustment dial 80 includes a shoulder having a smooth portion 81 and a V-cut portion 83. The shoulder is passed through a through-hole in a gauge ring 82 and threaded onto the thread second end 74 of the adjustment shaft 70 so that the adjustment shaft 70 continues to rotate within attachment block 66, yet is captivated in position between the collar 76 and the adjustment dial 80. This may also be described as "rotatably mounting" the adjustment shaft 70 to the attachment block 66. (The terms "rotatably mounted," "rotatably supported," and the like are used broadly herein—its definition depending in large part on the particular assembly of components involved.) The adjustment dial 80 is locked in place by threading a nut 84 onto tho threaded second end 74 of adjustment shaft 70 and, when the nut is about bottomed out against adjustment dial 80, aligning the fastener holes between the two parts and fastening the nut 84 to the adjustment dial 80 with fasteners 86.

A spring support 88 is mounted to the attachment block 66 with fasteners 90. The spring support 88 includes a pointer-89 for aligning with the numbers on the gauge ring 82 when adjusting the adjusting device. A gauge strip 92 is sandwiched between the spring support 88 and the attachment block 66. The gauge strip 92 includes markings that may be used by an operator to align with notches 85 in the second end of the arm 62 to coarsely adjust the adjustment between the metering roller 56 and the form roller 52 (e.g., when calibrating the adjustment devices.) A detent spring 94 is attached to the spring support 88 with fasteners 96. The detent spring 94 engages the V-cut portion 83 of adjustment dial 80 so an operator receives a detent-like feel as the adjustment dial 80 is rotated. Further, the combination assists in preventing the adjustment shaft 70 from rotating, and thereby altering the metering roller 56 to form roller 52 adjustment, during printing operations.

When a dampener is first assembled, and periodically thereafter, the adjustment devices should be calibrated. An adjustment device is calibrated when the nip 60 between metering roller 56 and form roller 52 is even along the lengths of the rollers and the gauge rings 82 of the near- and far-side adjustment devices have the same reading. Those of ordinary skill in the art appreciate that evenness of the rollers may be determined by placing a strip of paper between the nip of the rollers at each of the ends of the rollers. After making an adjustment between the metering roller 56 and form roller 52 with the adjustment device, the paper strips are pulled with a force gauge or by hand. The process is repeated until the paper strips pull out evenly from both ends (i.e., the force to pull out both strips of paper is about equal.) The arms 62 are then repositioned so they read on an appropriate gauge reading on gauge strips 92 and then secured in position with fasteners 64. Thereafter the gauge rings 82 are repositioned to have the same readings and are secured in position with fasteners 98 to the smooth portion 81 of the shoulder of adjustment dial 80.

Referring to FIG. 3, when not printing with printing press 10, the adjustment devices 17, 19 on the dampener 18 may be fully adjusted to separate the metering roller 56 from the form roller 52. That is, the adjustment dials 80 may be rotated to cause the arms 62 to rotate about axis "A" in the direction of arrow "D" to separate the rollers. Separating the rollers when the dampener is not in use helps to extend the life of the form roller and metering roller.

Figure 5:
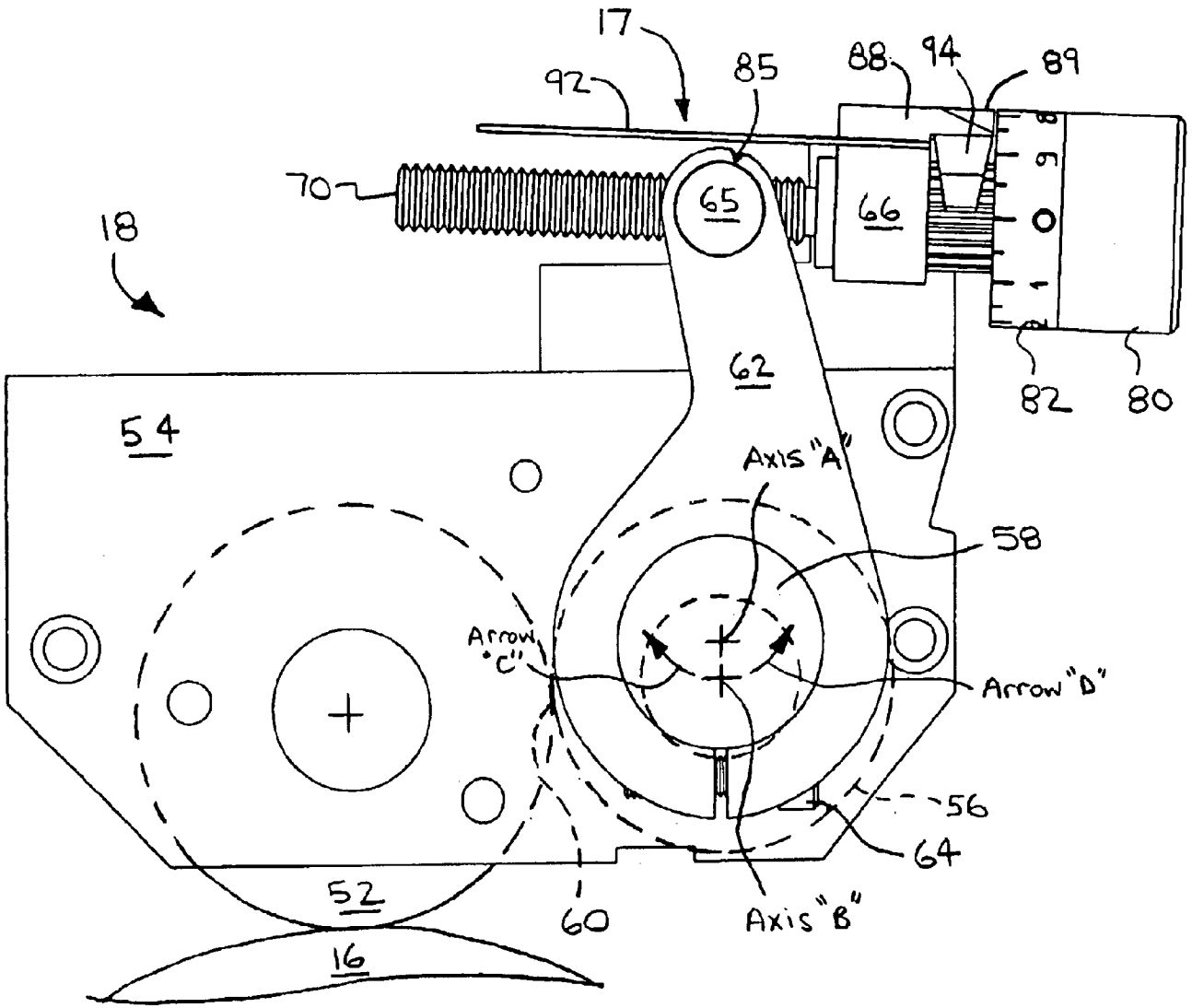
FIG. 5 is a side view of the dampener sideframe shown in FIG. 3, wherein the adjustment device has the metering roller adjusted almost filly toward the form roller.
Figure 6:
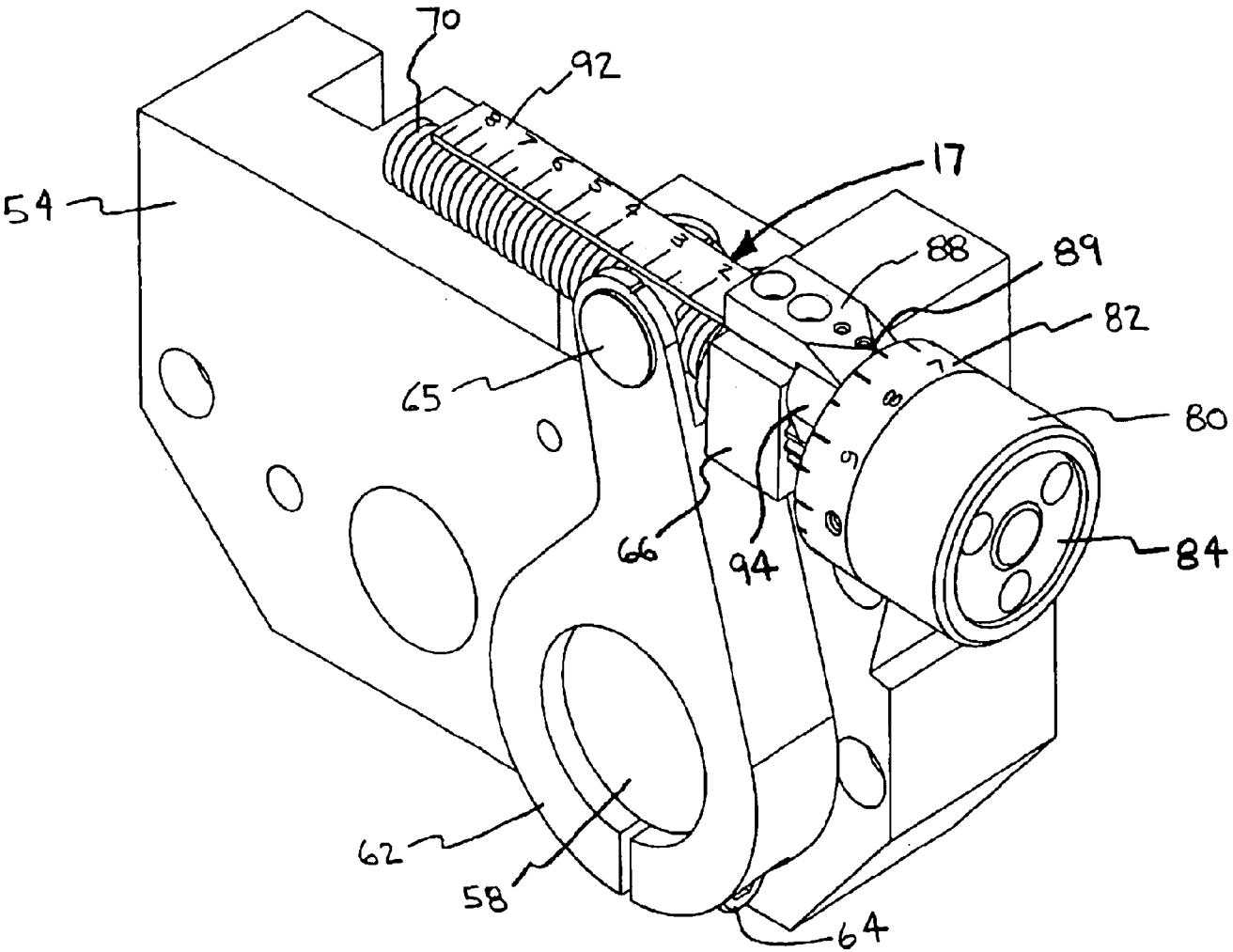
FIG. 6 is a perspective view of the dampener sideframe shown in FIG. 3.
Figure 7:
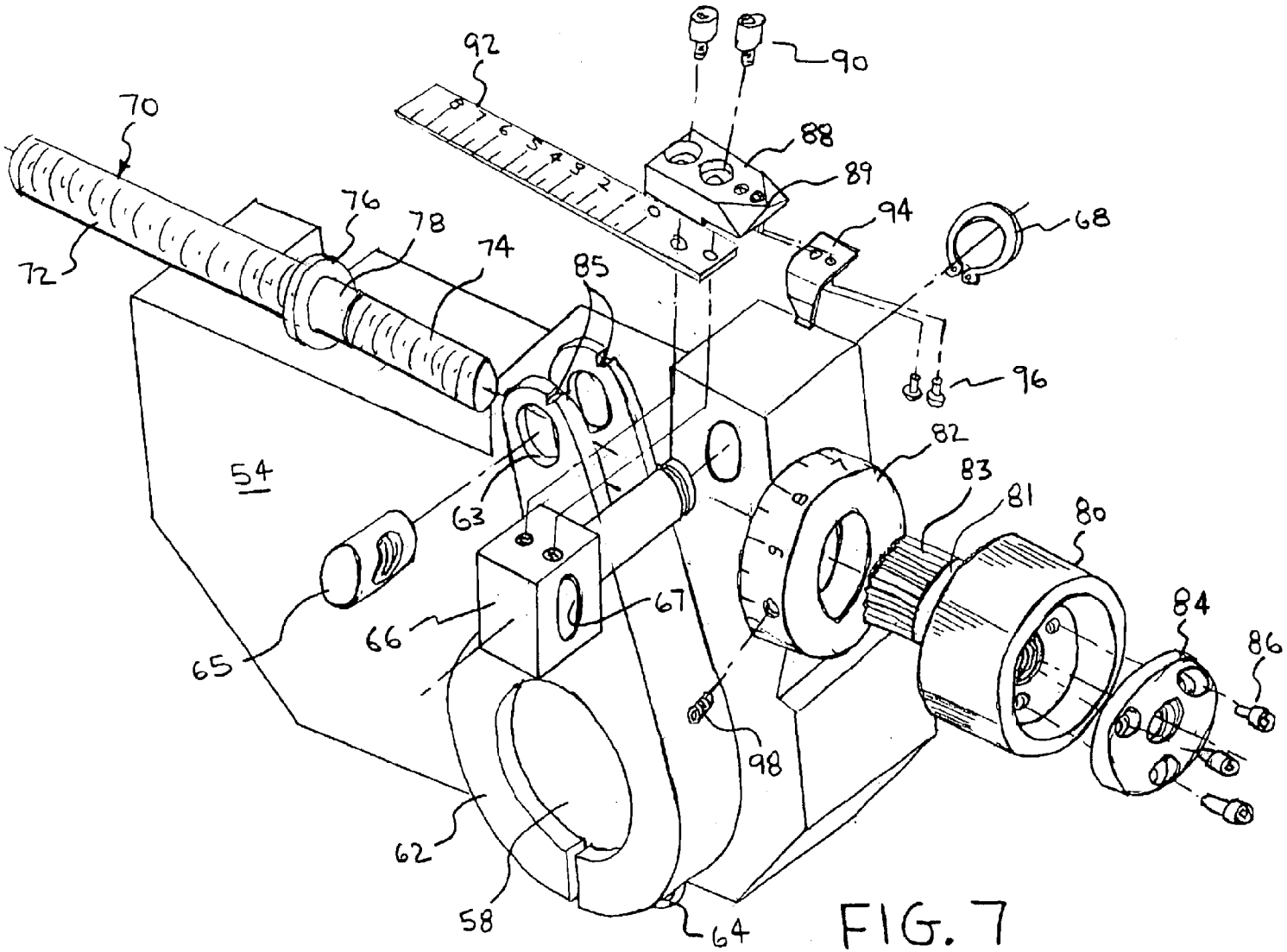
FIG. 7 is an exploded view of the sideframe shown in FIG. 6.

Referring to FIG. 5, when an operator desires to print with printing press 10, prior to adding dampening solution to the nip 60 between the metering roller 56 and form roller 52, the adjustment devices 17, 19 on dampener 18 are adjusted to operating position. To adjust the adjustment devices, adjustment dials 80 are rotated to cause the arms 62 to rotate about axis "A" in the direction of arrow "C". Initially, the adjustment dials 80 are adjusted so the notches 85 approximately align with a predetermined number on the gauge strips 92, and thereafter by aligning the numbers on the gauge rings 82 with the pointer 89 on spring support 88.

These numbers may be determined empirically from prior printing runs. Once notches 85 in arms 62 are approximately aligned with the predetermined numbers and the numbers on the gauge rings 82 are aligned with the; pointers 89 on the spring supports 88, dampening solution may be added to the reservoir formed above the nip 60. The adjustment between the metering roller 56 and form roller 52 can be fine-tuned by rotating the adjustment dials 80 as test sheets are run through the printing press.

Figure 8:
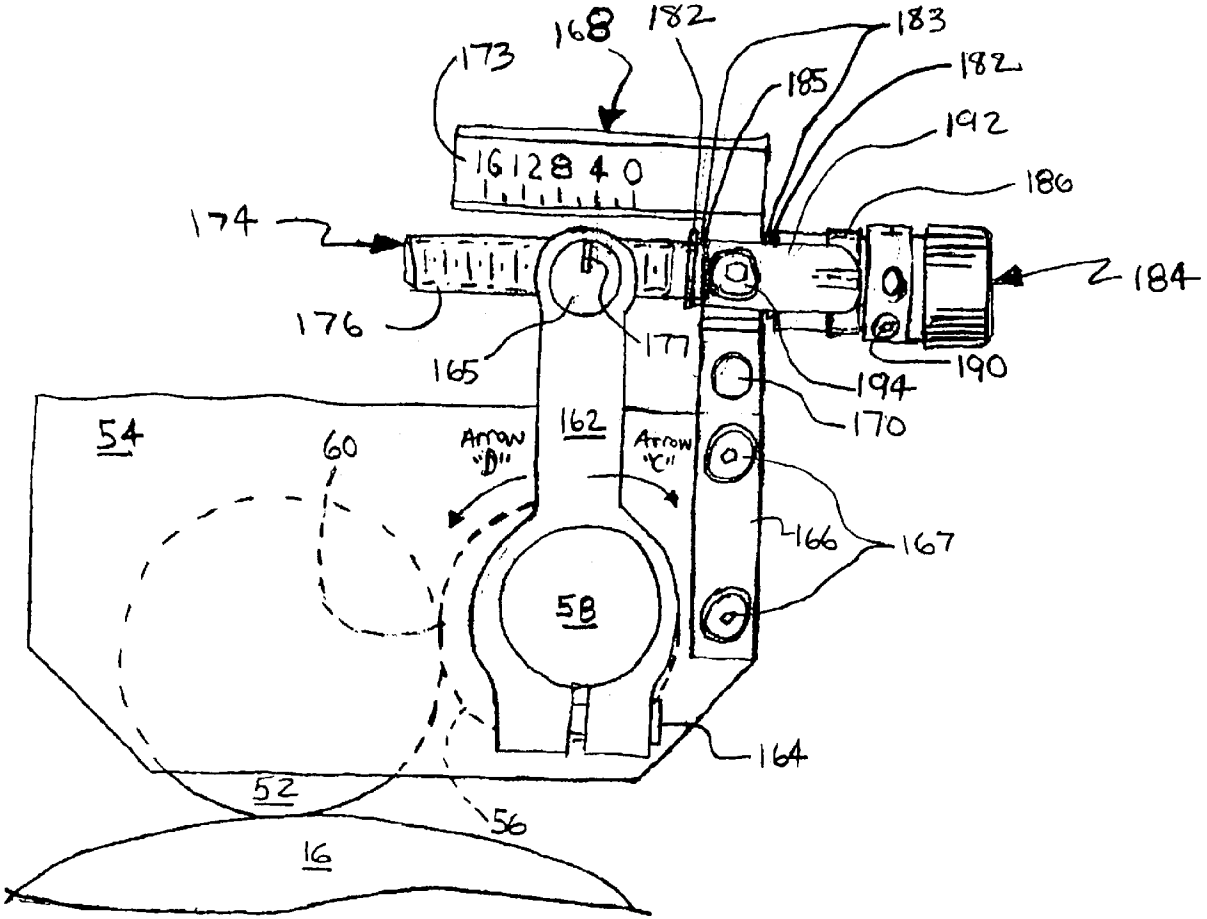
FIG. 8 is a side view of the dampener sideframe shown in FIG. 3 including another embodiment of an adjustment device.
Figure 9:
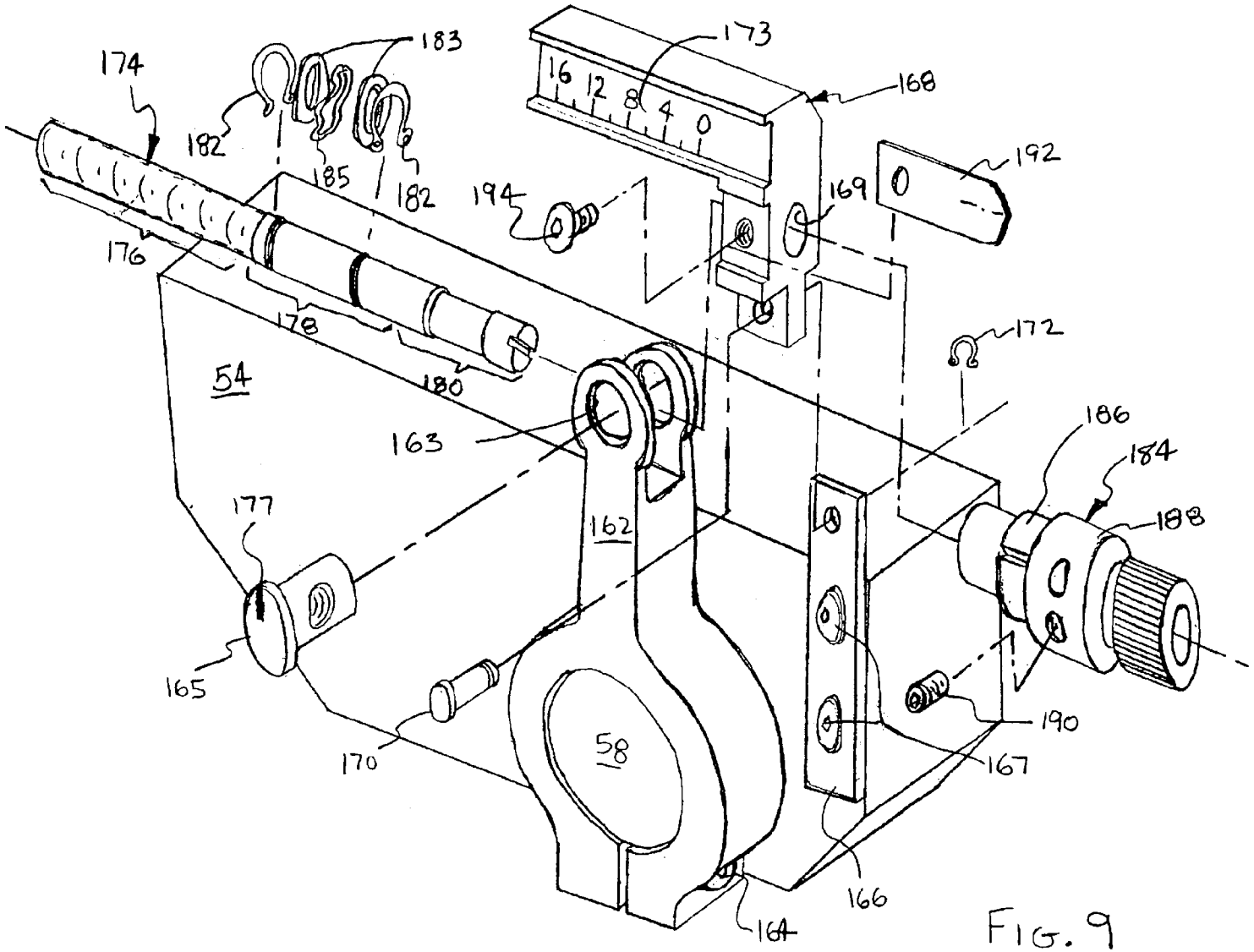
FIG. 9 is an exploded perspective view of the sideframe shown in FIG. 8.

Referring to FIGS. 8–9, views of a dampener sideframe similar to the dampener illustrated in FIG. 3 are shown, however, including another embodiment of an adjustment device.

A form roller 52 is rotatably supported (e.g., with ball bearings) by near-side sideframe 54 and a far-side sideframe (not shown) in parallel relationship with and contactable with the plate cylinder 16 during printing operations. A metering roller 56 is rotatably supported (e.g., with ball bearings) by eccentric collars 58, which are rotatably supported by the near-side sideframe 54 and far-side sideframe (not shown). The metering roller 56 is positioned adjacent the form roller 52 so a nip 60 may be formed there between. As described with respect to FIGS. 3–5 above, rotation of the eccentric collars 58 in the direction of arrow "C" causes the metering roller 56 to move toward the form roller 52 for reducing the amount of dampening solution allowed to pass through the nip 60, and rotation of the eccentric collars 58 in the direction of arrow "D" causes the metering roller 56 to move away from the form roller 52 for increasing the amount of dampening solution allowed to pass through the nip 60.

Each adjustment device includes an arm 162 having a first end and a second end. The first end of the arm 162 includes a split-ring configuration which is assembled to a shoulder of the eccentric collar 58 and clamped in place with a fastener 164. The second end of the arm 162 includes a cross-hole 163 through which a threaded pivot 165 is mounted. The threaded pivot 165 rotates freely in the cross-hole 163.

An attachment bar 166 is secured to the sideframe 54 with fasteners 167. An attachment block 168 is pivotally mounted to the attachment bar 166 with a pivot pin 170, which is secured in place with a retaining ring 172. The attachment block 168 includes a gauge 173 and defines a cross-hole 169.

An adjustment shaft 174 includes a threaded first end 176, a grooved central portion 178, and a grooved second end 180. The threaded first end 176 is threaded into the threaded pivot 165. The threaded pivot 165 includes a notch 177 for alignment with gauge 173 for calibrating the adjustment device. The grooved second end 180 extends through the cross-hole 169 in attachment block 168 and is retained in position by retaining rings 182 positioned in grooves machined into the grooved central portion 178 of the adjustment shaft 174. Flat washers 183 protect the retaining rings 182 when the adjustment shaft 174 is rotated. A wave washer 185 biases the adjustment shaft 174 so as to seat consistently against attachment block 168.

An adjustment dial 184 includes a shoulder 186 having four detents formed therein at 90 Deg. apart. A second shoulder 188 includes numbers 0–3, each number aligned with a detent. The adjustment dial 184 is mounted on the grooved second end 180 of the adjustment shaft 174 and secured in place with a fastener 190.

A detent spring 192 is mounted to the .attachment block 168 with a fastener 194. The detent spring 192 has a detent bent into one end that aligns with the detents formed in the shoulder 186 of the adjustment dial 184. Consequentially, as the adjustment dial 184 is rotated, a "click" (the sound and feel that occurs when the detent spring 192 mates with each detent on the adjustment dial 184) can be heard and felt by the operator, thereby making it significantly easier and more precise to make an adjustment Each "click" of the adjustment knob 184 is an incremental adjustment of the device. It will be readily apparent to those having ordinary skill in the art that other machine elements may be used to create the "click" attribute of the present invention. For example, a spring plunger may be used in place of the detent spring 192.

For the embodiment shown in FIGS. 8–9, the radial offset of the eccentrics 58 is about 0.094 inch, the center to center distance between the through-holes in the arm 162 is about 2.06 inches, and the thread on the adjustment shaft 174 is 5/16–18 UNC. This geometry results in about a 25.9 Deg. rotation of the arm 162 for the nip 60 to go from maximum pressure to no pressure between the form roller 52 and metering roller 56, which is gauged by the "0" to "16" gauge 173 on the attachment block 168. The adjustment shaft 174 must be rotated sixteen (16) times in order to rotate the arm 162 through this angle. Because there are four evenly-spaced detents on shoulder 186, it takes 64 "clicks" to move the arm 162 through the about 25.9 Deg. angle to go from minimum fluid passage to maximum fluid passage between the nip 60. Empirical data shows that the most frequently used range on the gauge 173 is "0" to "10".

Those of ordinary skill in the art will appreciate that gauges other than gauge 173 are useful. For example, instead of a gauge including "0" through "16", where "0" corresponds to minimum fluid passage through the nip 60 (i.e., maximum nip 60 pressure) and "16" corresponds to maximum fluid passage through the nip 60 (i.e., minimum nip 60 pressure), the gauge may include "0" through "4", where "0" corresponds to minimum pressure between the nip 60 (i.e., maximum fluid passage) and "4" corresponds to maximum pressure between the nip 60 (i.e., minimum fluid passage).

When a dampener including the adjustment device illustrated in FIGS. 8–9 is first assembled, and periodically thereafter, it should be calibrated. The adjustment device should be calibrated following a procedure similar to that discussed herein above with respect to the adjustment device illustrated in FIGS. 3–7.

Figure 10:
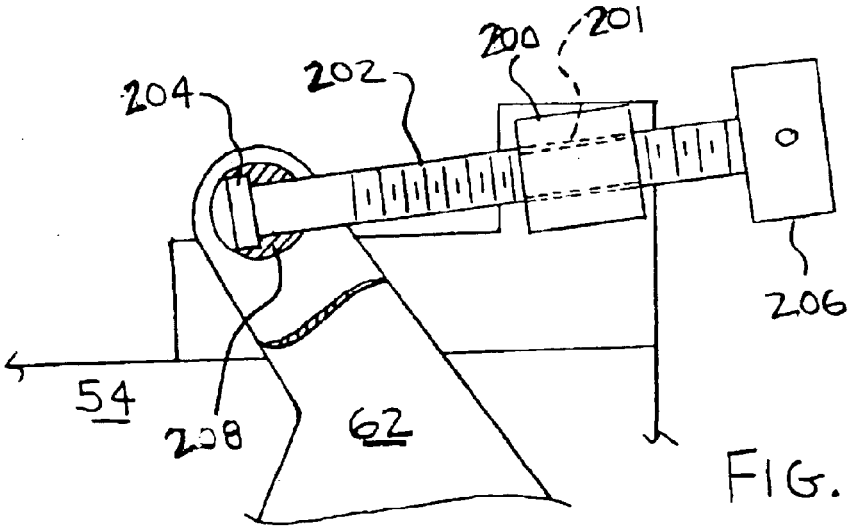
FIG. 10 is a side view of another embodiment of an adjustment device for a dampener.

FIG. 10 discloses another embodiment of an adjustment device that includes an attachment block 200 that is threaded 201 and rotatably mounted to sideframe 54. An adjustment shaft 202 includes a raised shoulder 204 on a first end, is threaded for most of the remainder of its length, and an adjustment dial 206 pinned to the second end. A recessed pivot 208 (shown in cross section) is mounted to the second end of the arm 62 (shown with the near-side leg partially removed): and configured to receive the raised shoulder 204 so that the adjustment shaft 202 may freely rotate when adjusting the metering roller 56 toward or away from the form roller 52. The threaded portion of the adjustment shaft 202 is threaded into the threaded portion 201 of the attachment block 200. Arms 62 may be adjusted so the metering roller 56 moves toward or away from the form roller 52 by rotating adjustment dial 206.

Figure 11:
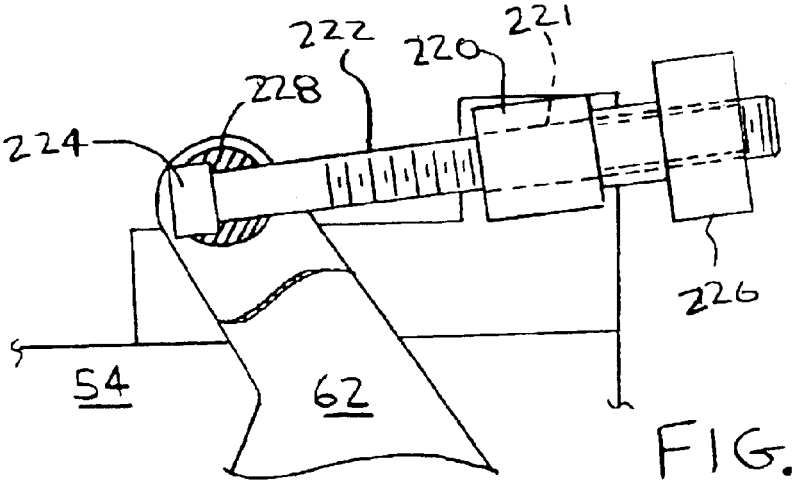
FIG. 11 is a side view of another embodiment of an adjustment device for a dampener.

FIG. 11 discloses another embodiment of an adjustment device that includes an attachment block 220 having a through-hole 221 and is rotatably mounted to sideframe 54. An adjustment shaft 222 includes a keyed shoulder 224 (e.g., a square head) on a first end, is threaded for most of the remainder of its length, and a threaded adjustment dial 226 threaded to the second end. A keyed pivot 228 (shown in cross section) is mounted to the second end of the arm 62 (shown with the near-side leg partially removed) and configured to receive the keyed shoulder 224 so that the adjustment shaft 222 will not rotate when adjusting the metering roller 56 toward or away from the form roller 52. The threaded portion of the adjustment shaft 222 passes through the through-hole 221 in the attachment block 220. Arms 62 may be adjusted so the metering roller 56 moves toward or away from the form roller 52 by rotating the threaded adjustment dial 226.

Figure 12:
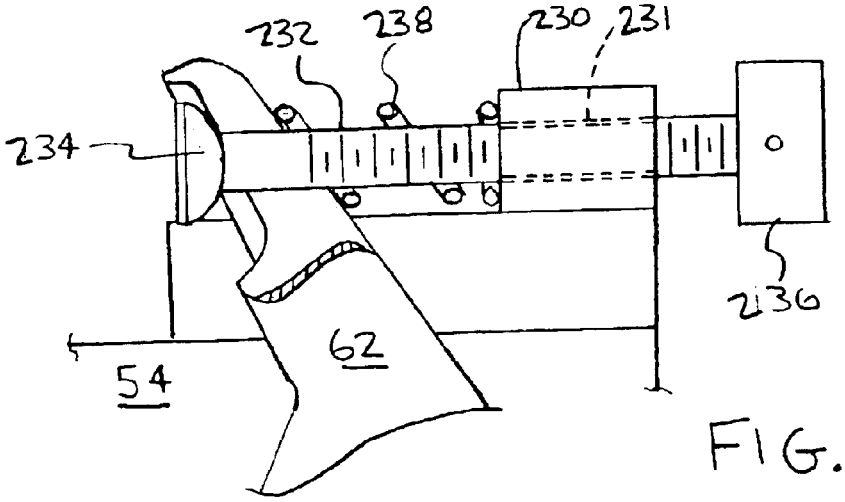
FIG. 12 is a side view of another embodiment of an adjustment device for a dampener.

FIG. 12 discloses another embodiment of an adjustment device that includes an attachment block 230 that is threaded 231 and rigidly mounted to the sideframe 54 (e.g., a separate piece pressed into the sideframe 54 or a boss machined from the sideframe 54). An adjustment shaft 232 includes a pan-shaped shoulder 234 on a first end, is threaded for most of the remainder of its length, and an adjustment dial 236 pinned to the second end. The second end of the arm 62 (shown with the near-side leg partially removed) is configured to receive the pan-shaped shoulder 234 so that the adjustment shaft 232 may freely rotate when adjusting the metering roller 56 toward or away from the form roller 52. The threaded portion of the adjustment shaft 232 is threaded into the threaded portion 231 of the attachment block 230. A compression spring 238 is mounted on the adjustment shaft 232 between the arm 62 and the attachment block 230 to ensure the pan-shaped shoulder 234 remains pressed against the second end of the arm 62. This is useful if an operator wants to separate the metering roller 56 from the form roller 52. Arms 62 may be adjusted so the metering roller 56 moves toward or away from the form roller 52 by rotating adjustment dial 236.

Those having ordinary skill in the art will appreciate that components of one of the adjustment devices may be used in one of the others. For example, the compression spring 238 in the adjustment device shown in FIG. 12 may be used in the adjustment device shown in FIG. 10 mounted on adjustment shaft 202 between the attachment block 200 and the arm 62. Therefore, with respect to any "means for" language (35 U.S.C. § 112 ¶ 6) used in the appended claims concerning such adjustment devices, the embodiments disclosed, any variation made from a combination of the elements of those embodiments, and any equivalents thereto are intended to be encompassed.

Figure 13:
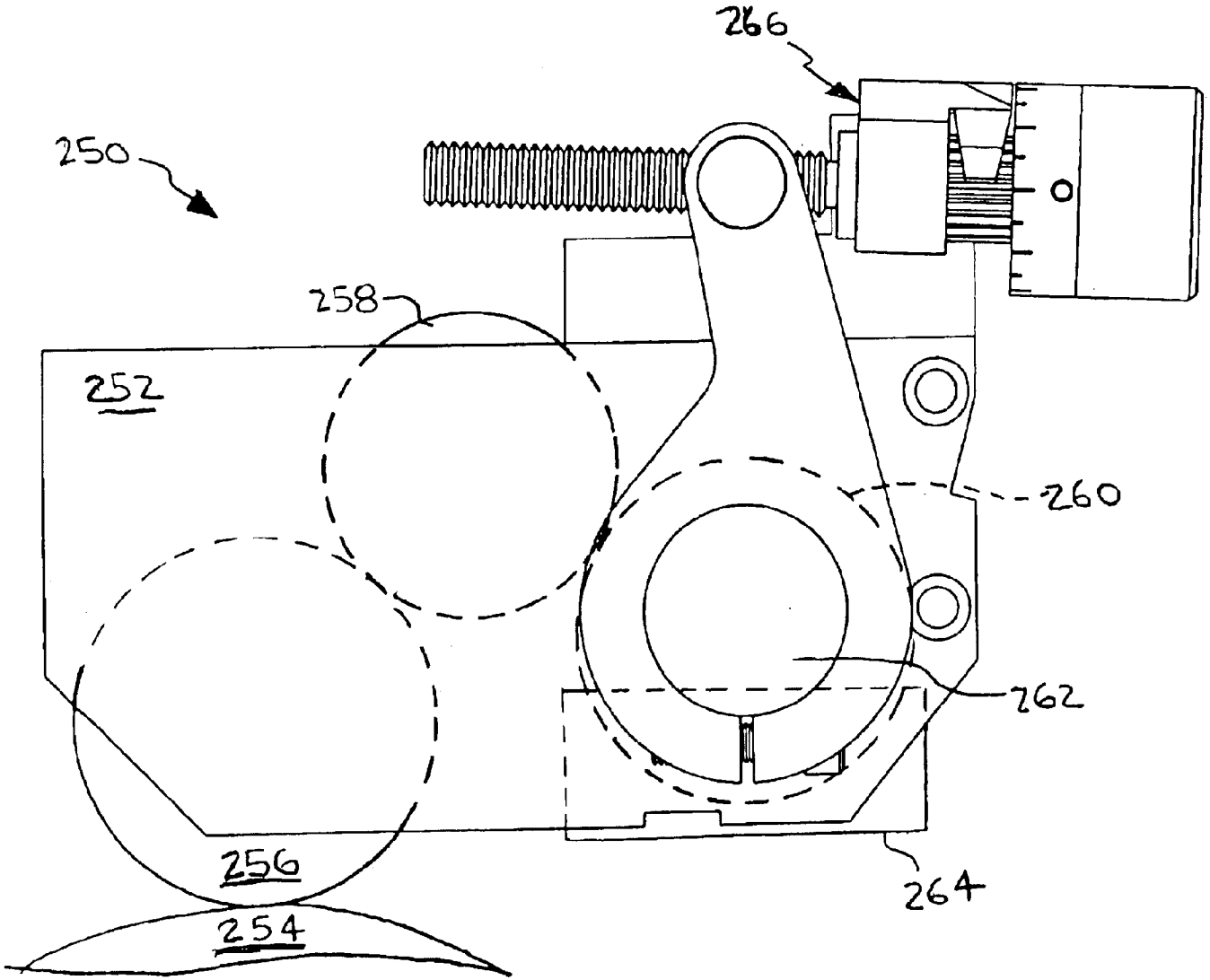
FIG. 13 is a side view of a pan-type continuous dampener including the embodiment of an adjustment device illustrated in FIG. 3.

Referring to FIG. 13, a side view of a pan-type continuous dampener 250 that incorporates an embodiment of the present invention is shown. The dampener 250 includes a pair of side frames 252 for supporting rollers adjacent a plate cylinder 254 in a printing press. A form roller 256 is rotatably supported by the sideframes 252 and is pressed against the plate cylinder 254 during printing operations. A metering roller 258 is rotatably supported by the sideframes 252 and pressed against the form roller 256. A pan roller 260 is rotatably supported by eccentric collars 262, which are rotatably supported by the sideframes 252. The pan roller 260 can be adjustably moved toward or away from the metering roller 258 to control the amount of dampening solution that is fed in the dampener 250. The pan roller 260 is partially immersed in a pan 264 of dampening solution during printing operations. An adjustment device 266, similar to the adjustment device described herein above with reference to FIGS. 3, and 5–7 for adjusting the eccentric collars in a seal-type continuous dampener, is included for adjusting the pan roller 260 toward or away from the metering roller 258.

Those of ordinary skill in the art will appreciate that another embodiment of the invention (not shown) may include the pan roller 260 rotatably mounted to the sideframes 252, and the metering roller 258 rotatably mounted in eccentric collars 262, which are rotatably mounted to the sideframes 252, and include adjustment devices 266 attached to the eccentric collars 262 for adjusting the metering roller 258 toward and away from the pan roller 260.

Kits can be conveniently made to enable a technician to retrofit the above-described invention onto a dampener in the field. That is, a kit can be made to retrofit an adjustment device onto a dampener including a first sideframe 54 and a second sideframe (FIG. 1) for supporting rollers adjacent a plate cylinder in a printing press. The dampener further including a first roller 52 rotatably supported by the first and second sideframes in parallel relationship with the plate cylinder 16 and a second roller 56 rotatably supported by eccentric collars 58 that are rotatably supported by the first and second sideframes, the second roller 56 adjacent the first roller 52 so that the second roller 56 may be adjustably pressed against the first roller 52.

Figure 14:
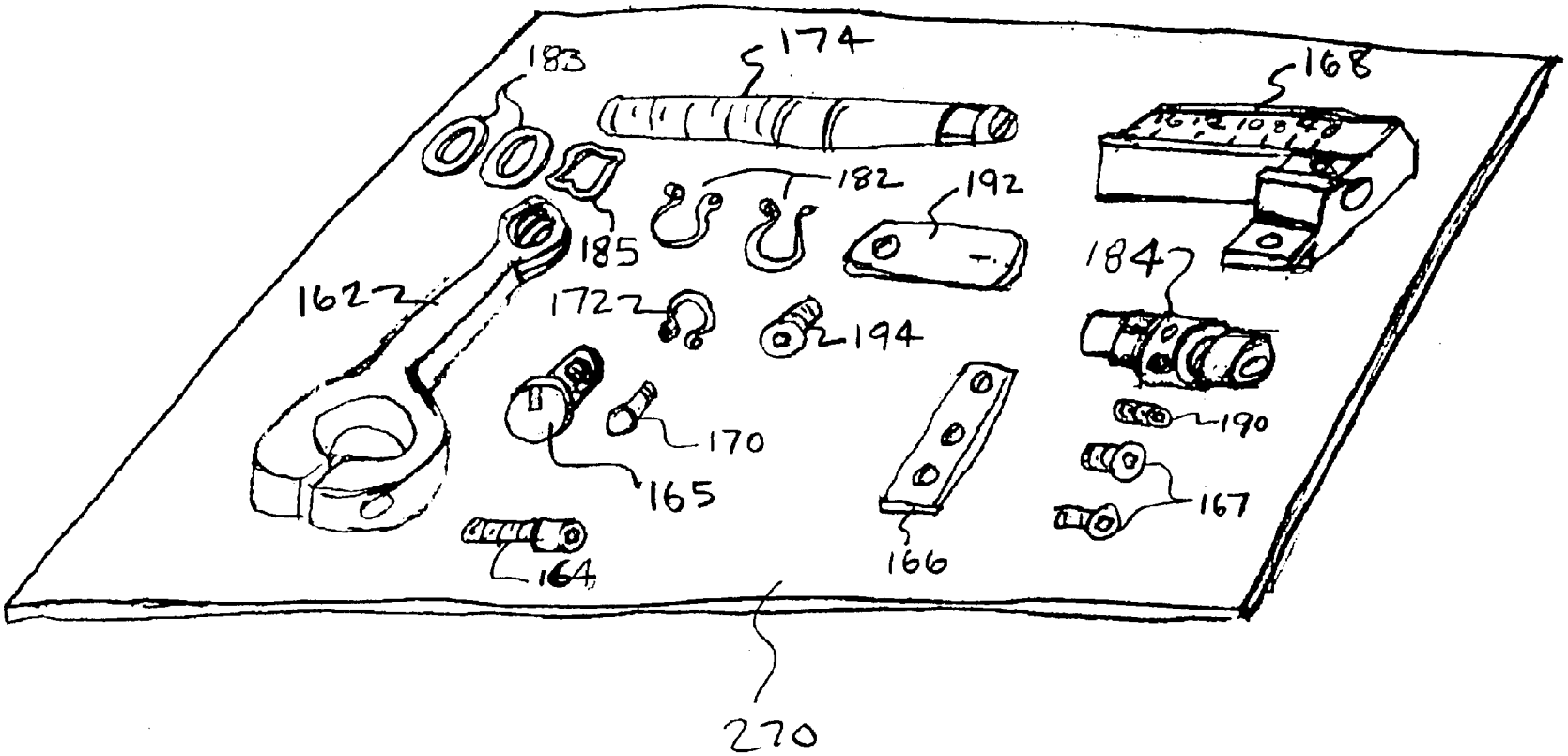
FIG. 14 illustrates a kit for an adjustment device.

Referring to FIG. 14, a kit may include the following components (only the left-hand sideframe kit is shown): packaging for containing the kit parts 270; an arm 162 having a first end and second end, the first end for attachment to the eccentric collar 58 of the dampener; an attachment block 168 mountable to an attachment bar 166, which is mountable to the side frame 54 of the dampener; and an adjustment shaft 174 having a first end and a second end, the first end of the adjustment shaft 174 threadingly engageable with a threaded pivot 165 that is mountable on the second end of the arm 162, a portion near the second end of the adjustment shaft 174 rotatably mountable to the attachment block 168, and an adjustment dial 184 mountable on the second end of the adjustment shaft 174 for enabling an operator to adjust the second roller 56 toward and away from the first roller 52. The kit further includes appropriate hardware for mounting the above-described components to the dampener. Packaging may include boxes, filler material, blister boards, shrink-wrap sheets, formed plastic packaging. While the invention has been described with respect to preferred embodiments, those of ordinary skill in the art will readily appreciate that various changes and/or modification can be made to the invention without departing from the spirit and scope of the invention as defined by the appended claims.

What is claimed is:

1. An improved dampener device for precisely metering dampening solution, in which dampener a first sideframe and a second sideframe for supporting rollers are adjacent to a plate cylinder in a printing press, a first roller is rotatably supported by the first and second sideframes so as to keep the first roller in parallel relationship with the plate cylinder, and a second roller is rotatably supported by a first eccentric collar and a second eccentric collar, the first eccentric collar being rotatably supported by the first side frame and the second eccentric collar being rotatably supported by the second sideframe, the second roller being adjacent to the first roller so as to be able to adjust the eccentric collars to move the second roller toward and away from the first roller to meter dampening solution in the dampener, wherein the improvement comprises:

a first adjustment device for rotating the first eccentric collar, and a second adjustment device for rotating the second eccentric collar, each adjustment device comprising an arm having a first end and second end, the first end attached to one of the eccentric collars, an attachment block mounted to the side frame, an adjustment shaft having a first end and a second end, the first end is threadingly engaged with one of the second end of the arm and the attachment block, and the second end is rotatingly mounted to the other of the second end of the arm and the attachment block, an adjustment dial mounted on the second end of the adjustment shaft for adjusting the second roller toward and away from the first roller, and a detent mating device mounted to the attachment block and engaged with a shoulder of the adjustment dial having at least two evenly-spaced detents.

2.The dampener device as recited in claim 1, wherein the first roller is a form roller contactable with the plate cylinder, and the second roller is a metering roller.

3. The dampener device as recited in claim 1, further including end seals pressed against end portions of the first roller and the second roller to form a dampening solution reservoir above a nip between the rollers.

4. The dampener device as recited in claim 1, further comprising a form roller rotatably supported in the dampener, pressed against the first roller, and contactable with the plate cylinder during printing operations.

5. The dampener device as recited in claim 1, wherein the first roller is a metering roller and the second roller is a pan roller.

6. The dampener device as recited in claim 1, further including a form roller rotatably supported in the dampener, pressed against the second roller, and contactable with the plate cylinder during printing operations.

7. The dampener device as recited in claim 6, wherein the second roller is a metering roller and the first roller is a pan roller.

8. The dampener device as recited in claim 1, wherein the attachment block is rotatably mounted to the sideframe.

9. The dampener device as recited in claim 8, wherein the first end of the adjustment shaft is threadingly engaged with a threaded pivot mounted on the second end of the arm and a portion near the second end of the adjustment shaft is rotatably mounted to the attachment block.

10. The dampener device as recited in claim 1, wherein the adjustment device is further configured so that about 64 clicks of the detent causes said second roller to move toward or away from said first roller by about 0.02 inches.

11. The dampener device as recited in claim 1, wherein the dampener is a pan-type continuous dampener.

12. The dampener device as recited in claim 1, wherein the dampener is a seal-type continuous dampener.

13. An improved dampener device for precisely metering dampening solution, in which dampener a first sideframe and a second sideframe for supporting rollers are adjacent to a plate cylinder in a printing press, a form roller is rotatably supported by the first and second sideframes in parallel relationship with and contactable with the plate cylinder, a metering roller is rotatably supported by eccentric collars, which are rotatably supported by the first and second sideframes, the metering roller being positioned adjacent to the form roller so as to form a nip between the rollers, and end seals being pressed against end portions of the form roller and the metering roller to form a dampening solution reservoir above the nip between the rollers, the improvement comprising:

adjustment devices for rotating the eccentric collars, each adjustment device including an arm having a first end and second end, the first end attached to one of the eccentric collars, an attachment block mounted to the side frame, an adjustment shaft having a first end and a second end, the first end is threadingly engaged with one of the second end of the arm and the attachment block, and the second end is rotatingly mounted to the other of the second end of the arm and the attachment block, an adjustment dial mounted on the second end of the adjustment shaft for adjusting the metering roller toward and away from the form roller, and a detent mating device mounted to the attachment block and engaged with a shoulder of the adjustment dial having at least two evenly-spaced detents.

14. The dampener device as recited in claim 13, wherein the attachment block is rotatably mounted to the sideframe.

15. The dampener device as recited in claim 13, wherein the first end of the adjustment shaft is threadingly engaged with a threaded pivot mounted on the second end of the arm and a portion near the second end of the adjustment shaft is rotatably mounted to the attachment block.

16. The dampener device as recited in claim 13, further including wherein the adjustment device is further configured so that about 64 clicks of the detent causes the metering roller to move toward or away from the form roller, by about 0.02 inches.

17. A kit of components for a device for precisely metering dampening solution in a dampener, in which dampener a first sideframe and a second sideframe for supporting rollers are adjacent to a plate cylinder in a printing press, a first roller being rotatably supported by the first and second sideframes in parallel relationship with the plate cylinder, and a second roller being rotatably supported by eccentric collars, which are rotatably supported by the first and second sideframes, the second roller being adjacent the first roller so as to press the second roller adjustably against the first roller, the kit comprising:

packaging material for containing components of the kit, adjustment devices for rotating the eccentric collars, each adjustment device comprising, an arm having a first end and second end, the first end for attachment to one of the eccentric collars, an attachment block mountable to the side frame, an adjustment shaft having a first end and a second end, the first end being threadingly engagable with one of the second end of the arm and the attachment block, and the second end being rotatingly mountable to the other of the second end of the arm and the attachment block, an adjustment dial being mountable on the second end of the adjustment shaft for adjusting the second roller toward and away from the first roller, and a detent mating device being mountable to the attachment block and engaged with a shoulder of the adjustment dial having at least two evenly-spaced detents.

18. The kit as recited in claim 17, wherein the adjustment devices are further configured so that about 64 clicks of the detent causes said second roller to move toward or away from said first roller by about 0.02 inches.

19. The kit as recited in claim 17, wherein the dampener is a pan-type continuous dampener.

20. The kit as recited in claim 17, wherein the dampener is a seal-type continuous dampener.

* * * * *

UNITED STATES PATENT AND TRADEMARK OFFICE

CERTIFICATE OF CORRECTION

PATENT NO. : 6,796,228 B2
DATED : September 28, 2004
INVENTOR(S) : Goodwin et al.

It is certified that error appears in the above-identified patent and that said Letters Patent is hereby corrected as shown below:

Column 3,
Line 27, "dampener," should read -- dampener; --
Line 40, "filly" should read -- fully --

Column 6,
Line 7, "onto tho" should read -- onto the --

Column 7,
Line 4, "with the;" should be -- with the --

Column 8,
Line 6, "adjustment Each" should read -- adjustment. Each --
Line 54, "removed): and" should read -- removed) and --

Column 10,
Line 37, "Packaging may include boxes, filler material, blister boards, shrink-wrap sheets, formed plastic packaging. While" should read -- Packaging may include boxes, filler material, blister boards, shrink-wrap sheets, formed plastic packaging.
While --

Column 12,
Lines 21-22, "further including" should read -- claim 13, wherein --

Signed and Sealed this

Seventeenth Day of May, 2005

JON W. DUDAS
*Director of the United States Patent and Trademark Office*